US009908057B2

(12) United States Patent
McCarthy

(10) Patent No.: US 9,908,057 B2
(45) Date of Patent: Mar. 6, 2018

(54) WATER RIDE ATTRACTION

(71) Applicant: AIRWAVE LIMITED, Wanaka (NZ)

(72) Inventor: Ross McCarthy, Dunedin (NZ)

(73) Assignee: Airwave Limited, Wanaka (NZ)

( * ) Notice: Subject to any disclaimer, the term of this patent is extended or adjusted under 35 U.S.C. 154(b) by 0 days.

(21) Appl. No.: 14/913,942

(22) PCT Filed: Aug. 22, 2014

(86) PCT No.: PCT/IB2014/064017
§ 371 (c)(1),
(2) Date: Feb. 23, 2016

(87) PCT Pub. No.: WO2015/025298
PCT Pub. Date: Feb. 26, 2015

(65) Prior Publication Data

US 2016/0199744 A1 Jul. 14, 2016

(30) Foreign Application Priority Data

Aug. 23, 2013 (NZ) ..... 614679

(51) Int. Cl.
*A63G 21/18* (2006.01)
*A63G 31/00* (2006.01)
(Continued)

(52) U.S. Cl.
CPC ..... *A63G 31/007* (2013.01); *A63B 69/0093* (2013.01); *A63G 21/18* (2013.01);
(Continued)

(58) Field of Classification Search
CPC ..... A63G 21/00; A63G 21/18; A63G 31/00; A63G 31/007; A63G 31/12; A63B 2009/008; A63B 2225/605; A63B 2225/62
(Continued)

(56) References Cited

U.S. PATENT DOCUMENTS 3,733,360 A 5/1973 Firth
4,762,316 A 9/1988 Merino
(Continued)

FOREIGN PATENT DOCUMENTS

CA 2637030 4/2007
CN 201257292 6/2009
(Continued)

OTHER PUBLICATIONS

US 7,367,894, 05/06/2006, Lochtefeld, (withdrawn).

*Primary Examiner* — Kien Nguyen
(74) *Attorney, Agent, or Firm* — Lewis Rice LLC

(57) ABSTRACT

A wave form for a water ride attraction having an inflatable cushion with a ride surface adapted to support a rider. The ride surface has a substantially planar section, followed by an upwardly inclined concave section, and then a horizontally inclined convex section. A wake form for a water ride attraction has an inflatable cushion having a ride surface. The ride surface has a substantially planar central section, flanked by an upwardly inclined concave section on one side and an upwardly inclined concave section on the other side. A water ride attraction has an inflatable wave form or wake form and a water delivery arrangement for delivering a flow of water to the inflatable wave form or wake form in a flow direction. The ride surface is arranged to allow a rider to ride on the flow of water in a direction generally transverse to the direction of water flow.

56 Claims, 15 Drawing Sheets

(51) Int. Cl.
*A63B 69/00* (2006.01)
*E04H 4/12* (2006.01)

(52) U.S. Cl.
CPC ..... *E04H 4/12* (2013.01); *A63B 2225/605* (2013.01); *A63B 2225/62* (2013.01)

(58) Field of Classification Search
USPC ..... 472/13, 116, 117, 128, 134; 104/53, 69, 104/70
See application file for complete search history.

(56) References Cited

U.S. PATENT DOCUMENTS 5,401,117 A 3/1995 Lochtefeld
5,564,859 A 10/1996 Lochtefeld
6,019,547 A 2/2000 Hill
6,062,983 A 5/2000 Butsook
6,132,317 A * 10/2000 Lochtefeld ..... A63B 69/0093 472/117
6,336,771 B1 1/2002 Hill
6,364,782 B1 * 4/2002 Ochi ..... A47C 27/085 472/134
6,648,767 B1 11/2003 Chen
6,676,530 B2 1/2004 Lochtefeld
6,716,107 B2 4/2004 Lochtefeld
6,758,231 B1 * 7/2004 Lochtefeld ..... A63G 3/00 104/70
6,912,738 B2 7/2005 Black
7,309,302 B1 * 12/2007 Phillips ..... A63C 19/10 472/116
7,547,255 B2 6/2009 Lochtefeld
7,666,104 B2 * 2/2010 Lochtefeld ..... A63B 69/0093 405/52
7,789,804 B1 * 9/2010 Phillips ..... A63B 69/18 482/148
2005/0148398 A1 * 7/2005 Lochtefeld ..... A63B 69/0093 472/117

FOREIGN PATENT DOCUMENTS

JP H10137450 A 5/1998
WO 2006000777 A1 1/2006
WO 2009064445 A1 5/2009

* cited by examiner

WATER RIDE ATTRACTION

CROSS REFERENCE TO RELATED APPLICATION(S)

This application is a § 317 U.S. National Phase of International Application Serial No.: PCT/IB2014/064017 filed Aug. 22, 2014, which is turn claims the benefit of New Zealand Patent Application Serial No. 614679, filed Aug. 22, 2013. The entire disclosure of both the above documents is herein incorporated by reference.

FIELD OF THE INVENTION

This invention relates to a water ride attraction, wave forms for a water ride attraction, and a method of entertaining a rider on a water ride attraction.

BACKGROUND

Amusement park attractions include wave machines that replicate natural waves. Wave machines typically have hard surfaces forming the ride sections of the wave machine. The hard surfaces do not absorb impact if a rider falls during or after riding a wave. It is known for riders to suffer broken bones, bruises, grazes and concussions as a result of falling while riding a wave on a water ride attraction.

Another disadvantage of known wave machines is the wave machine can only create one type of wave. Know wave machines do not create surfing waves and wake-type waves. Rather, two different wave machines are required for different wave types.

It is an object of the present invention to provide a water ride attraction that overcomes the disadvantages of known water ride attractions, and/or to at least provide the public with a useful alternative.

SUMMARY OF THE INVENTION

Surfing Wave Form

In accordance with a first aspect of the invention, there is provided a wave form for a water ride attraction comprising: an inflatable cushion having a ride surface and an interior the ride surface being adapted to support a rider, the ride surface having a substantially planar section, follow by an upwardly inclined concave section, and then a horizontally inclined convex section; and the interior having a first compartment corresponding to the planar section of the ride surface, a second compartment corresponding to the concave section of the ride surface, and a third compartment corresponding to the convex section of the ride surface, the compartments forming a support structure of the wave form and each compartment comprising a plurality of longitudinal adjacent cells, each cell being adapted such that the pressure of the cell can be increased or decreased to manipulate the shape and size of the wave formed by the wave form.

In an embodiment, the planar section is adapted to direct water to flow to the concave section and the concave section is adapted to direct water to flow to the convex section.

In an embodiment, the planar surface is inclined relative to a horizontal surface. The planar surface is inclined at an angle of about 0 degrees to about 89 degrees, preferably about 5 degrees relative to the horizontal surface.

In an embodiment, the wave form further comprises a water removal section for removing water from the convex section. The convex section is preferably adapted to direct water to flow to the water removal section. Water preferably flows through the water removal section under the influence of gravity.

In an embodiment, the wave form further comprises side barriers extending along the sides of the wave form. The side barriers are preferably integrally formed with the planar section, concave section, and convex section. The side barriers preferably follow the profile of the ride surface. The side barriers preferably provide a resilient impact surface for the rider. Additionally, the side barriers preferably substantially contain the water flow over the ride surface.

In an embodiment, the planar section, concave section, and convex section are integrally formed.

In an embodiment, the cushion is filled with air. In an alternative embodiment, the cushion may be filled with a suitable gas or liquid.

Each of the compartments may be a single compartment or may comprise a plurality of sub-compartments.

In an embodiment, each of the compartments has a predetermined internal pressure. The internal pressure of the first compartment is a relatively high pressure compared to the pressure of the other compartments.

In an embodiment, the internal pressure of the first compartment is about 1 psi to about 30 psi. The internal pressure of the first compartment is suitably chosen so that the planar section of the ride surface is relatively inflexible to provide a relatively smooth flow of water.

In an embodiment, the internal pressure of the second compartment is about 1 psi to about 30 psi. The internal pressure of the second compartment is preferably chosen to provide a relatively smooth flow of water and also a resilient impact surface for the rider.

In an embodiment, the internal pressure of the third compartment is about 1 psi to about 30 psi. The internal pressure of the third compartment is preferably chosen to provide a resilient impact surface for the rider.

In an embodiment, the wave form comprises a valve for controlling the air pressure in the wave form. Each compartment preferably comprises a valve. The pressure in each of the compartments may be varied to alter the way in which water flows over the wave form, which allows for different types of waves to be created. The pressure may also be adjusted to provide a softer or harder impact surface for the rider.

In an embodiment, the wave form is releasably attachable to a water ride attraction. The wave form may be releasably attachable via hook and look fasteners, zip fasteners, straps, or dome fasteners, for example.

In an embodiment, the wave form is formed from a flexible sheet material. The flexible material may be chosen from cotton, polyester, rayon, or PVC for example. The flexible material will suitably comprise a waterproof material. The coating may be a laminate or coating of rubber, polyvinyl chloride, polyurethane, silicone elastomer, fluoropolymers, and/or wax.

Wake/Ramp Wave Form

In accordance with a second aspect of the invention, there is provided a wake form for a water ride attraction comprising: an inflatable cushion having a ride surface and an interior, the ride surface having a substantially planar central section, flanked by an upwardly inclined concave section on one side and an upwardly inclined concave section on the other side the interior having a central compartment corresponding to the central section of the ride surface and side compartments corresponding to the concave sections of the ride surface, the compartments forming a support structure of the wake form and each compartment comprising a plurality of longitudinal adjacent cells, each cell being adapted such that the pressure of the cell can be increased or decreased to manipulate the shape and size of the wave formed by the wave form.

In an embodiment, the wake form further comprises a water delivery section for delivering water to the central section. The water delivery section extends downwardly towards the central section.

The wake form also has a water removal section for removing water from the central section.

In an embodiment, the planar surface is downwardly inclined relative to a horizontal surface. The planar surface is inclined at an angle of about 0 degrees to about 89 degrees, preferably about 5 degrees relative to the horizontal surface.

In an embodiment, the wake form further comprises side barriers extending along the sides of the wake form. The side barriers are preferably integrally formed with the concave sections. The side barriers preferably follow the profile of the ride surface. The side barriers preferably provide a resilient impact surface for the rider. Additionally, the side barriers preferably substantially contain the water flow over the ride surface.

In an embodiment, the planar section and concave sections are integrally formed.

In an embodiment, the cushion is filled with air. In an alternative embodiment, the cushion may be filled with a suitable gas or liquid.

Each of the compartments may be a single compartment or may comprises a plurality of sub-compartments.

In an embodiment, each of the compartments has a predetermined internal pressure. The internal pressure of the central compartment is a relatively high pressure compared to the pressure of the other compartments.

In an embodiment, the internal pressure of the central compartment is about 0 psi to about 30 psi. In an embodiment, the internal pressure of each of the side compartments is about 1 psi to about 30 psi. The internal pressure of each of the central and side compartments is preferably chosen to provide a relatively smooth flow of water and also a resilient impact surface for the rider.

In an embodiment, the wake form comprises a valve for controlling the air pressure in the wake form. Each compartment preferably comprises a valve. The pressure in each of the compartments may be varied to alter the way in which water flows over the wake form, which allows for different types of wakes to be created. The pressure may also be adjusted to provide a softer or harder impact surface for the rider.

In an embodiment, the wake form is releasably attachable to a water ride attraction. The wake form may be releasably attachable via hook and look fasteners, zips, straps, or domes, for example.

In an embodiment, the wake form is formed from a flexible sheet material. The flexible material may be chosen from cotton, polyester, rayon, or PVC for example. The flexible material will suitably comprise a waterproof material. The coating may be a laminate or coating of rubber, polyvinyl chloride, polyurethane, silicone elastomer, fluoropolymers, and/or wax.

In an embodiment, the wake form has an additional wake forming projection. The additional wake forming projection is preferably an inflatable cushion. The additional wake forming projection may comprise a valve for controlling the air pressure in the additional wake forming projection. The pressure in the additional wake forming projection may be varied to alter the way in which water flows over the wake form, which allows for different types of wakes to be created.

The additional wake forming projection preferably has a longitudinal direction aligned with the direction of water flow. The length of the additional wake forming projection in the longitudinal direction is about 1.5 meters. The width of the additional wake forming projection is about 300 mm, and the height of the additional wake forming projection is about 200 mm.

Wave Machine

In accordance with a third aspect of the invention, there is provided a water ride attraction comprising: an inflatable wave or wake form having a ride surface and an interior, the interior having two or more compartments, the compartments forming a support structure of the wave or wake form and each compartment comprising a plurality of longitudinal adjacent cells, each cell being adapted such that the pressure of the cell can be increased or decreased to manipulate the shape and size of the wave formed by the wave form; a water delivery arrangement for delivering a flow of water to the inflatable wave form in a flow direction; the ride surface being so arranged as to allow a rider to ride on the flow of water above the ride surface in a direction generally transverse to the direction of water flow.

In an embodiment, the inflatable wave form comprises the wave form of the first aspect described above. In alternative embodiment, the inflatable wake form comprises the wake form of the second aspect described above.

In an embodiment, the inflatable wave form is selectively interchangeable with another inflatable wave form.

In an embodiment, the water ride attraction further comprises a base. The inflatable wave form is preferably releasably attachable to the base.

In an embodiment, the water delivery arrangement further comprises a water reservoir for storing water. In one embodiment, the water delivery arrangement may be adapted to deliver water from a natural source of water, such as a lake, river, stream, or the sea.

In an embodiment, the water reservoir comprises a funnel having a tank and a stem. In an embodiment, the water reservoir comprises a baffle between the tank and the stem. The stem preferably comprises a substantially vertical section that leads into a transverse section. The transverse section has a variable outlet to control the flow of water out of the stem. The variable outlet preferably comprises a gate.

In an embodiment, the water ride attraction further comprises a pool for collecting water from the wave form. The water removal section may include a drain in communication with the pool. The drain is preferably in communication with the reservoir for delivering water from the pool to the water reservoir.

In an embodiment, the water delivery arrangement further comprises a pump for pumping the water to the water reservoir. In a preferred embodiment, the water is continuously recycled from the pool to the reservoir, over the ride surface and back to the pool.

In an embodiment, the water delivery arrangement is adapted to deliver water to the inflatable wave form at a speed of up to about 50 km/hr, preferably about 30 km/hr.

In an embodiment, the water delivery arrangement is adapted to deliver water to the inflatable wave form at a depth of about 75 mm to about one meter.

In an embodiment, the water ride attraction further comprises a line having a first end attached to a support and a second end for a rider to hold. The second end of the line preferably includes a handle. The length of the line suitable corresponds to the distance between the support and the central section of the wave form. The line is preferably a retractable rope. The line is preferably a spring-loaded line.

Method of Using the Wave Machine with the Surfing Wave Form

In accordance with a fourth aspect of the invention, there is provided a method of entertaining a rider using a water ride attraction comprising: providing a water ride attraction having an inflatable wave form of the first aspect; delivering water to the wave form such that the water flows in a direction from the planar section, over the upwardly inclined concave section, and then over the horizontally inclined convex section; and allowing a rider to ride on the water above the ride surface in a direction generally transverse to the direction of water flow.

In an embodiment, the rider rides in a direction substantially perpendicular to the direction of water flow.

In an embodiment, the rider initially rides on the water above the planar section of the wave form and is carried to the concave section by the flow of water. Once at the concave section, the rider can ride on the water.

In an embodiment, the method further comprises ceasing the flow of water, causing the rider to exit the riding area of the water ride attraction. The rider may land on the convex section and/or one of the side barriers.

In an embodiment, the period of time that the rider uses the water ride attraction is controllable. For example, the period of time may be limited to about one minute.

In an embodiment, the method further comprises adjusting the internal pressure of one or more of the compartments of the wave form. The internal pressure may be adjusted before and/or during a rider riding on the water.

In an embodiment, the method further comprises removing the wave form and replacing the wave form with a different wave form.

In an embodiment, the method further comprises collecting water from the wave form in a pool. The method further comprises delivering the water collected in the pool to the water reservoir. The water is preferably delivered to the water reservoir by pumping the water. In a preferred embodiment, the water is continuously recycled from the pool to the reservoir, over the ride surface and back to the pool.

In an embodiment, the water delivery arrangement is adapted to deliver water to the inflatable wave form at a speed of up to about 50 km/hr, preferably about 30 km/hr.

In an embodiment, the water delivery arrangement is adapted to deliver water to the inflatable wave form at a depth of about 75 mm to about one meter.

Method of Using the Wave Machine with the Wake/Ramp Wave Form

In accordance with a fifth aspect of the invention, there is provided a method of entertaining a rider using a water ride attraction comprising: providing a water ride attraction having an inflatable wave form of the second aspect; delivering water to the wave form such that the water flows in a direction over the central section; allowing a rider to ride on the water in a direction substantially transverse to the direction of water flow.

In an embodiment, the rider rides in a direction substantially perpendicular to the direction of water flow. The rider preferably rides at least partly over one of the side concave surfaces, through the central section and at least partly over the other of the side concave surfaces. The rider preferably repeatedly rides from one side to the other and back again.

In an embodiment, the rider initially rides along the planar section of the wave form and is carried to the concave section by the flow of water.

In an embodiment, the method further comprises ceasing the flow of water, causing the rider to exit the riding area of the water ride attraction. The rider may land on the convex section and/or one of the side barriers.

In an embodiment, the period of time that the rider uses the water ride attraction is controllable. For example, the period of time may be limited to about one minute.

In an embodiment, the method further comprises adjusting the internal pressure of the wave form. The internal pressure may be adjusted before and/or during a rider riding on the water.

In an embodiment, the method further comprises removing the wave form and replacing the wave form with a different wave form.

In an embodiment, the method further comprises collecting water from the wave form in a pool. The method further comprises delivering the water collected in the pool to the water reservoir. The water is preferably delivered to the water reservoir by pumping the water.

In a preferred embodiment, the water is continuously recycled from the pool to the reservoir, over the ride surface and back to the pool.

In an embodiment, the water delivery arrangement is adapted to deliver water to the inflatable wave form at a speed of up to about 50 km/hr, preferably about 30 km/hr.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

As used herein the term "(s)" following a noun means the plural and/or singular form of that noun.

As used herein the term "and/or" means "and" or "or", or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF A PREFERRED EMBODIMENT

Figure 1:
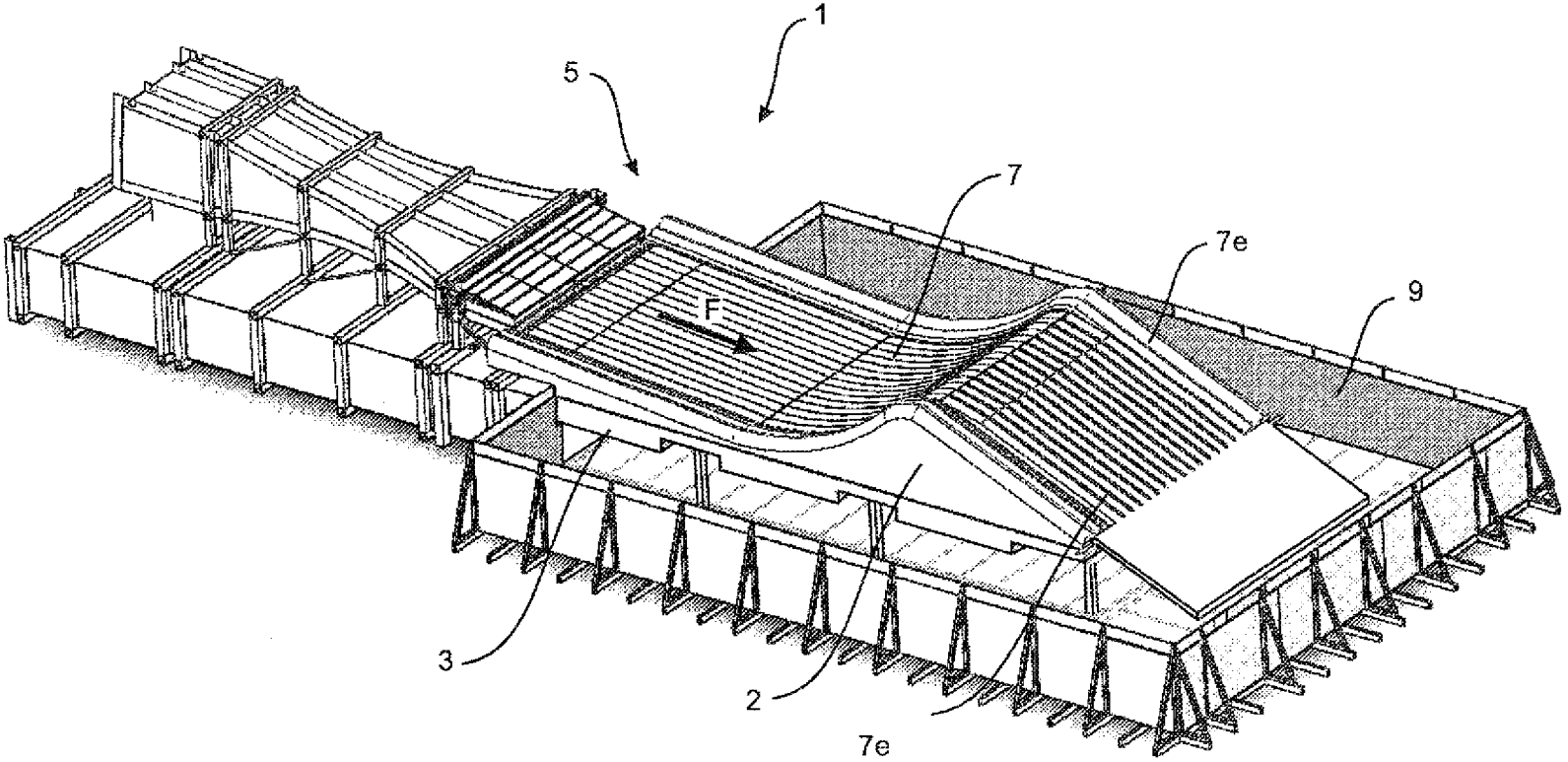
FIG. 1 is a perspective view of a first preferred embodiment water ride attraction.
Figure 2:
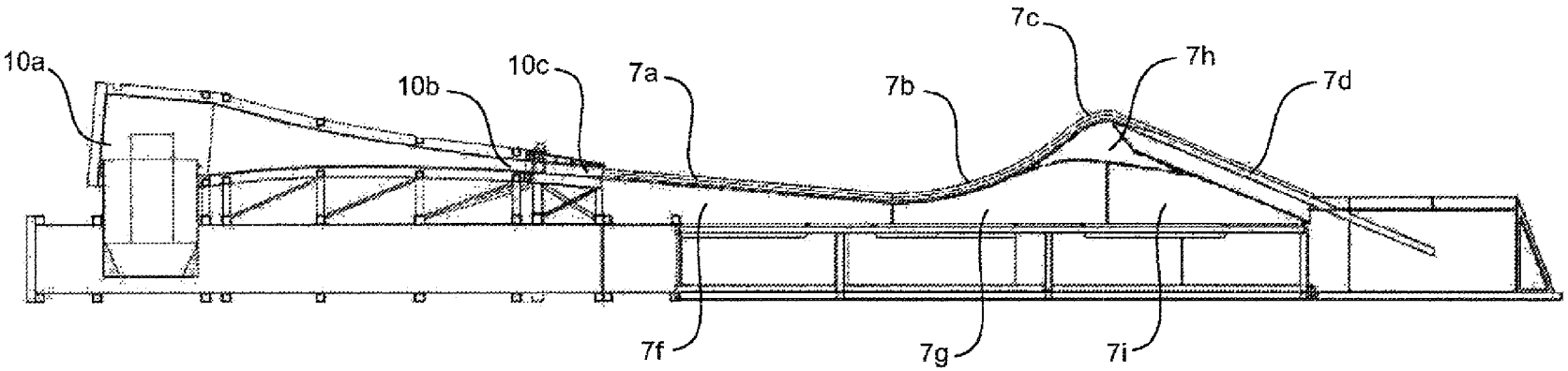
FIG. 2 is a cross-sectional view of the water ride attraction of FIG. 1.

With reference to FIGS. 1 and 2, a first preferred embodiment of a water ride attraction is shown, indicated generally by reference number 1.

The water ride attraction 1 has an inflatable wave form 2 attached to a base 3, and a water delivery arrangement 5 for delivering a flow of water to the inflatable wave form 2 in a flow direction F. The wave form has a ride surface 7 that is arranged as to allow a rider to ride on the flow of water above the ride surface in a direction generally transverse to the direction F of water flow. In the preferred embodiment shown, the water ride attraction 1 has a pool 9 for collecting water from the wave form 2.

Figure 2A:
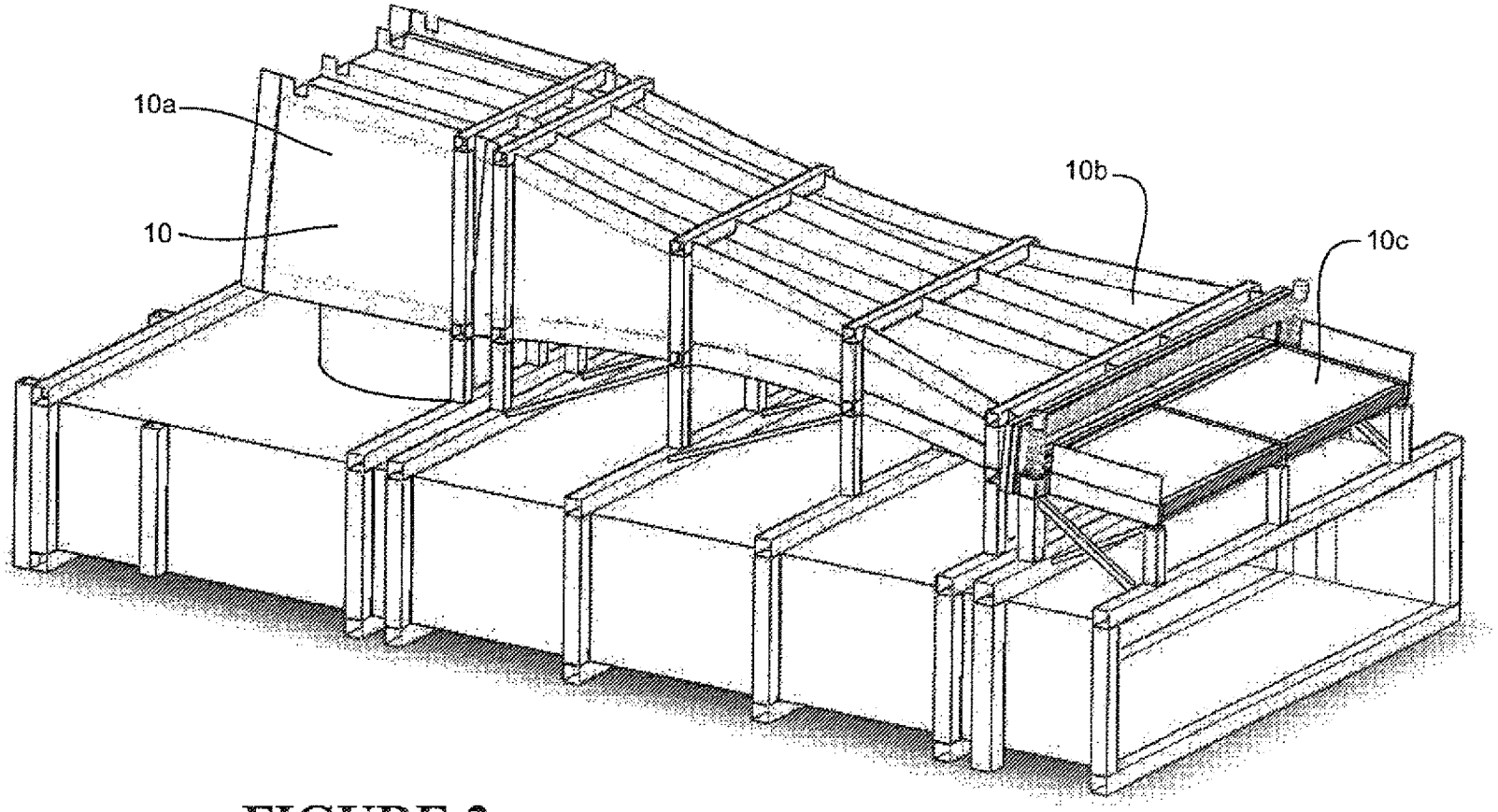
FIG. 2*a* is a perspective view of a water delivery duct.

With reference to FIG. 2*a*, the water delivery arrangement comprises a duct 10 having a wide inlet 10*a* and a narrower outlet 10*b*. The outlet has a gate 10*c* providing a variable outlet size to control the flow of water from the outlet. The outlet 10*b* has a substantially rectangular shape. The outlet 10*b*, together with the gate 10*e*, provides a smooth flow of water. The gate controls the flow of water to a depth of about 25 mm to about 150 mm, and may be up to one meter.

The water delivery arrangement has one or more pumps (not shown) for pumping the water to the duct inlet 10*a*. The pumps are bolted to the base of the pool 9. The pump is suitably rated to draw a head of about 10 m.

In the preferred embodiment, the water is continuously recycled from the pool 9 to the reservoir, over the ride surface 7 and back to the pool 9. The water delivery arrangement is adapted to deliver water to the inflatable wave form at a speed of up to about 50 km/hr, preferably about 30 km/hr.

The water ride attraction 1 has a spring-loaded, retractable line (not shown) having a first end attached to a support (not shown) and a second end for a rider to hold. The second end of the line includes a handle (not shown). The length of the line corresponds to the distance between the support and the central section of the wave form.

Figure 3:
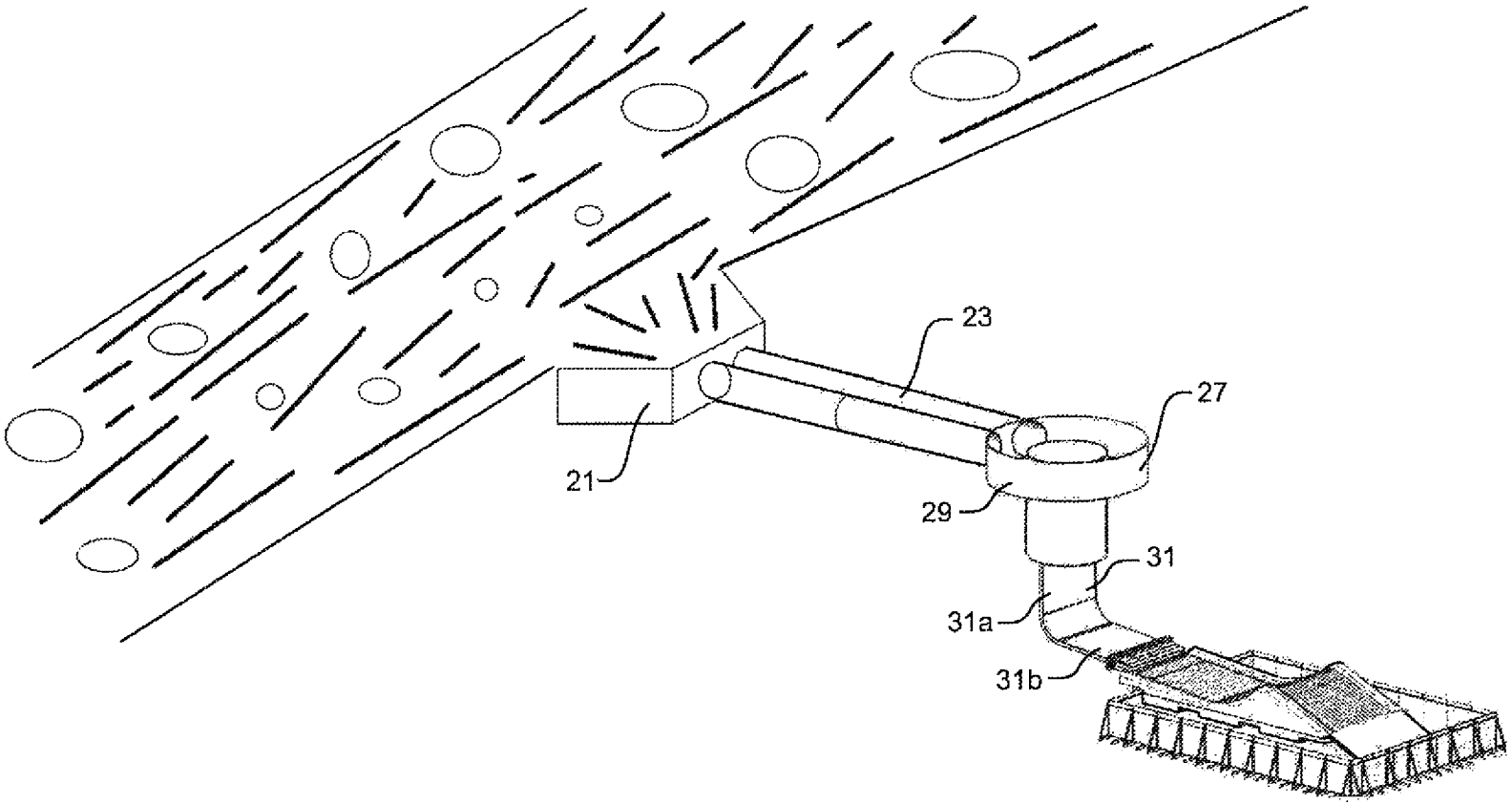
FIG. 3 is a perspective view of a second preferred embodiment water ride attraction associated with a river.
Figure 4:
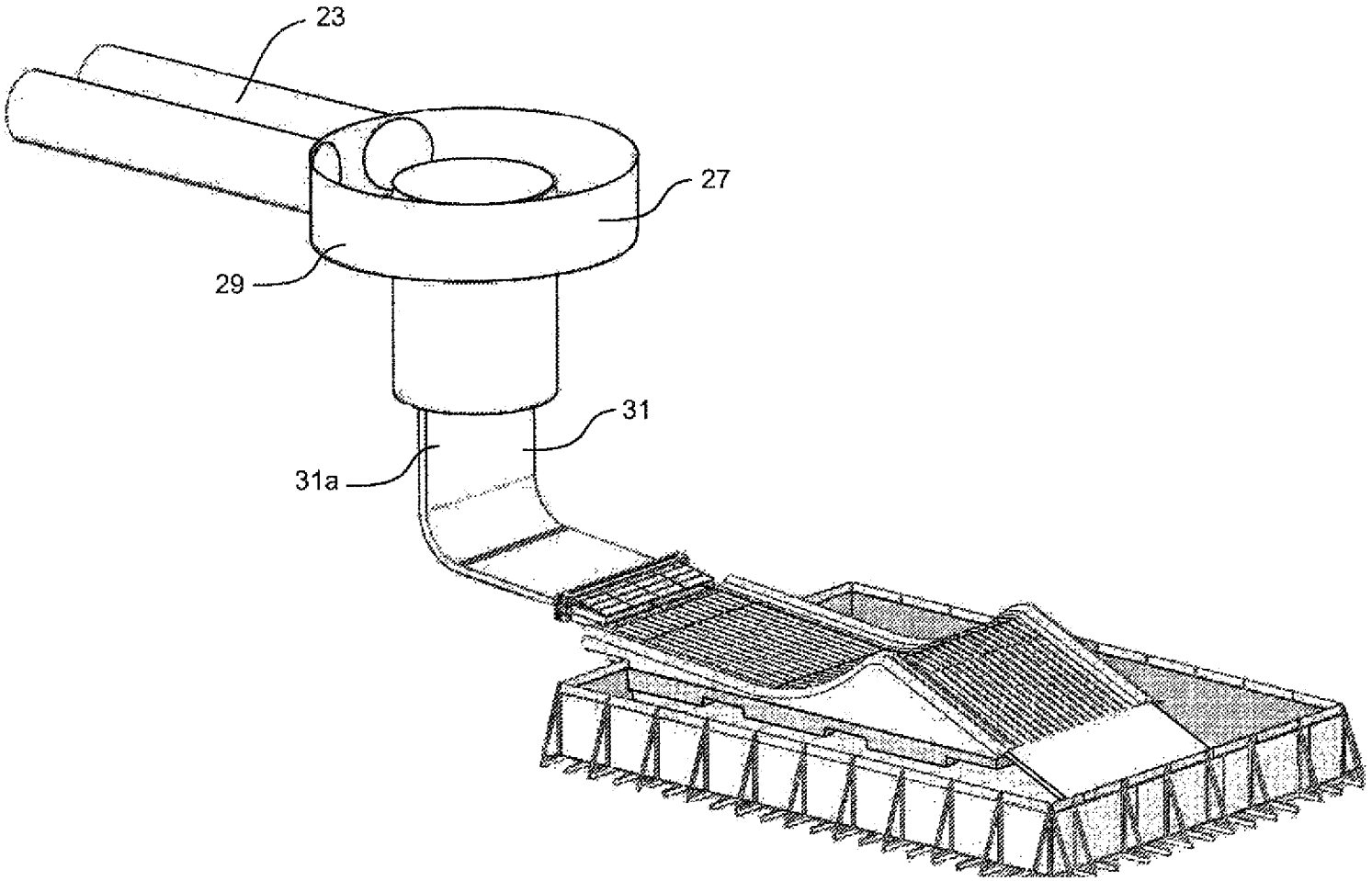
FIG. 4 is a perspective view of the water ride attraction of FIG. 3.

With reference to FIGS. 3 and 4, a second preferred embodiment of the water ride attraction is shown. The second preferred embodiment water ride attraction is similar to the first embodiment of the water ride attraction, except as described below. In the second preferred embodiment, the water delivery arrangement is adapted to deliver water from a natural source of water W, such as a river, lake, stream, or the sea. An inlet 21 feeds water from the natural water source W, via pipes 23 to a water reservoir 25 for storing water at velocities of about 500-40,000 liters per second. After the water flows over the wave form, it is re-circulated to the river.

The water reservoir comprises a funnel 27 having a tank 29 and a stem 31. The stem 29 has a substantially vertical section 31*a* that leads into a transverse section 31*b*. The transverse section has a variable outlet to control the flow of water out of the stem. In the preferred embodiment shown, the funnel has a gate to control the flow of water out of the stem at a depth of about 25 mm to about 150 mm, and may be up to about one meter.

The stem 31*a* extends downwardly towards the wave form 2 at an angle of 5 degrees relative to the horizontal surface. During use, the funnel provides a relatively smooth supply of water to the wave form.

Figure 5:
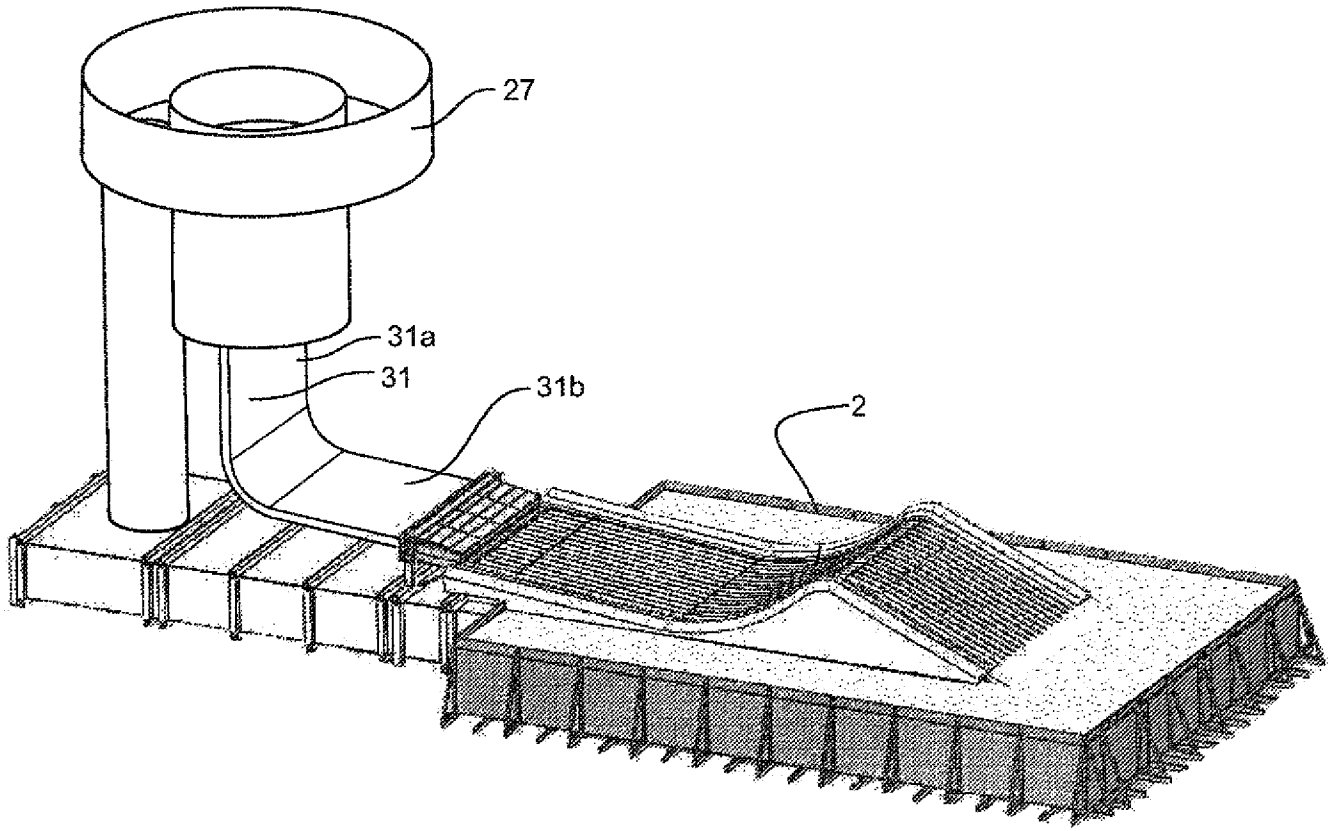
FIG. 5 is a perspective view of a third preferred embodiment water ride attraction.
Figure 6:
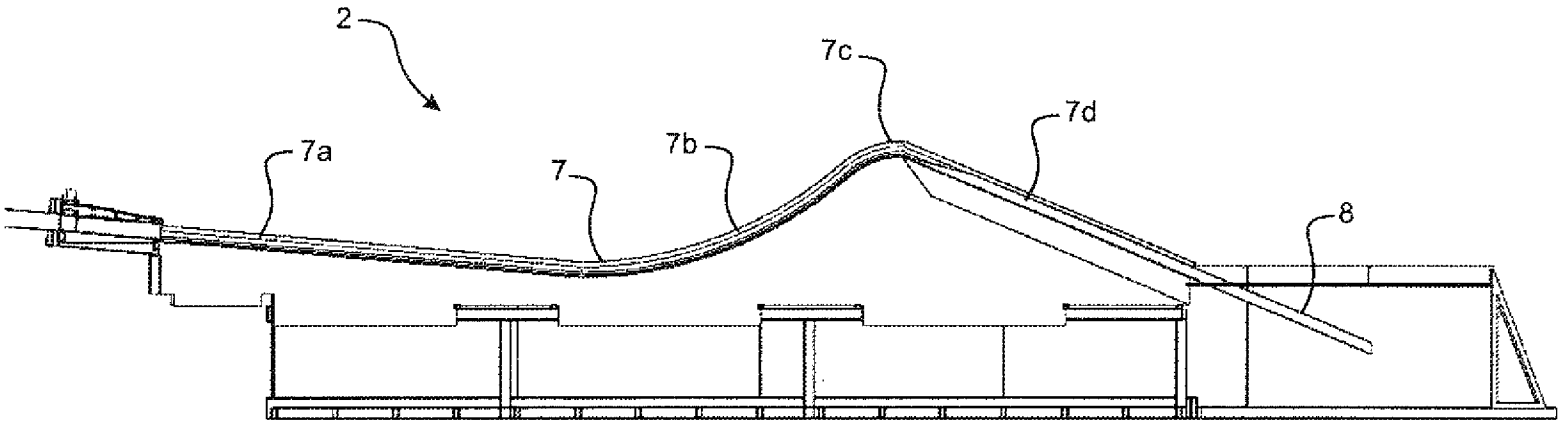
FIG. 6 is a cross-sectional view of a wave form together with an associated pool, and gate.

FIG. 5 shows an alternative design to the design of FIGS. 3 and 4. The third preferred embodiment water ride attraction is similar to the second embodiment of the water ride attraction, except as described below. The water is re-circulated from the pool to reservoir by one or more pumps, rather than having water delivered from a river.

The water ride attraction 1 of FIGS. 1 to 5 includes the first preferred embodiment wave form 2. The wave form 2 is a surfing wave form. In the preferred embodiment shown, the inflatable wave form is selectively interchangeable with another wave form.

The wave form 2 is an inflatable cushion having a ride surface 7 adapted to support a rider. The ride surface 7 has a substantially planar section 7*a*, follow by an upwardly inclined concave section 7*b*, and then a horizontally inclined convex section 7*c*. In the preferred embodiment shown, the planar section, concave section, and convex section are integrally formed. The entire ride surface 7 includes a cover 8, secured by tie downs 8*a*. The cover comprises a polypropylene material which is attached to the wave form using hook and loop fasteners. It is also fixed to the front of the duct and gate.

Figure 11:
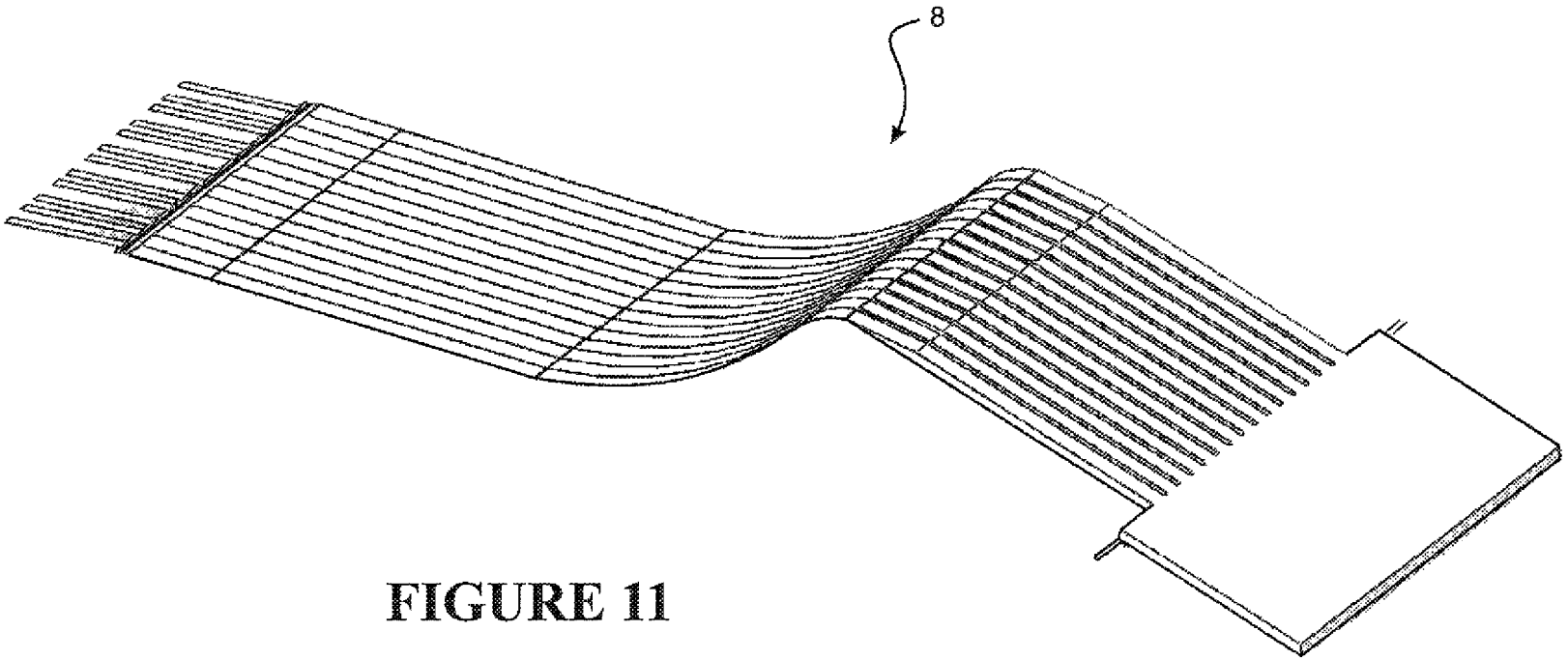
FIG. 11 is a perspective view of a cover for a wave form.

With reference to FIG. 11, the cover 8 of the ride surface 7 has inflatable strips with a net between the strips, which the water falls through separating the water from the rider. There is a gap between the wave form and the ride surface which allows the water to run down and return to the pool without pushing the rider down under the water. It will be appreciated that the wave form creates the basic structure, while the cover creates a riding surface. One advantage of the cover is that it protected the inflatable wave form. In particular, the wave form can support surfboards with fins.

The planar surface 7*a* is inclined relative to a horizontal surface. The planar surface 7*a* can be inclined at an angle of about 0 degrees to about 89 degrees. In the preferred embodiment shown, the angle is about 5 degrees relative to the horizontal surface. As shown in FIG. 2, the planar section 7*a* is adapted to direct water to flow to the concave section 7*b* and the concave section is adapted to direct water to flow to the convex section 7*c*.

In the preferred embodiment shown, the wave form further comprises a water removal section 7*d* for removing water from the convex section and providing an exit area for a rider. The convex section is adapted to direct water to flow to the convex section. Water flows through the water removal section under the influence of gravity.

Figure 12:
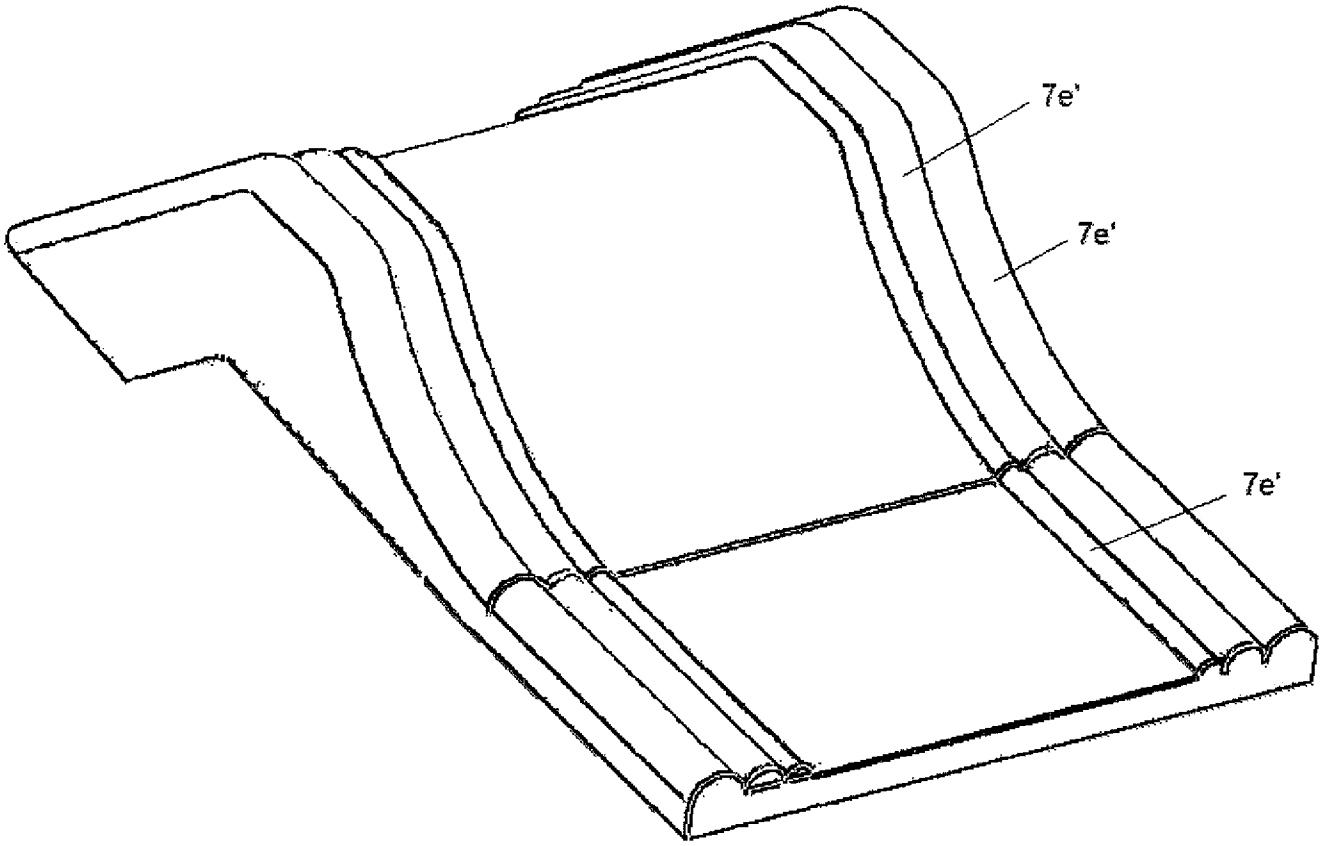
FIG. 12 is a perspective view of a preferred embodiment wave form.
Figure 13:
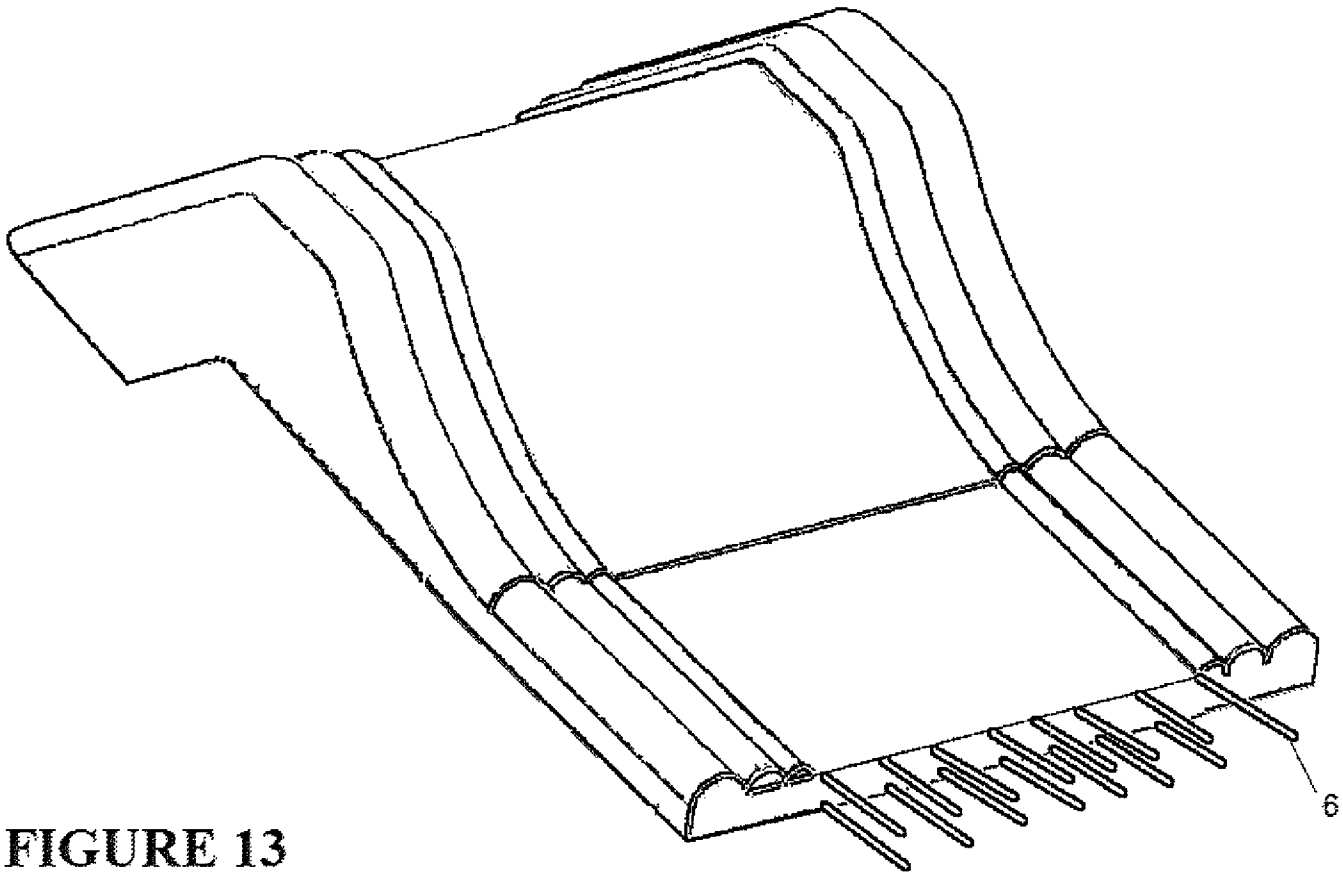
FIG. 13 is a perspective view of the preferred embodiment wave form of FIG. 12 showing straps for attaching the wave form.

In the preferred embodiment shown, the wave form 2 further comprises side barriers 7*e* extending along the sides of the wave form. The side barriers 7*e* are integrally formed with the planar section 7*a*, concave section 7*b*, and convex section 7*c* and follow the profile of the ride surface 7. The side barriers provide a resilient impact surface for the rider and substantially contain the water flow over the ride surface 7. FIGS. 12 and 13 show an alternative embodiment in which the side barriers 7*e* are formed form more than one compartment 7*e'*.

In the preferred embodiment shown, the interior of the cushion has compartments corresponding to the sections of the ride surface 7. The interior of the cushion has a first compartment 7*f* corresponding to the planar section 7*a* of the ride surface, a second compartment 7*g* corresponding to the concave section 7*b* of the ride surface, a third compartment 7*h* corresponding to the convex section 7*c*, of the ride surface, and a fourth compartment 7*i* corresponding to the water removal section 7*d*.

Each of the compartments has a predetermined internal pressure. The internal pressure of the first compartment is a relatively high pressure compared to the pressure of the other compartments. In the preferred embodiment shown, the internal pressure of the first compartment 7*f* is about 1 psi to about 30 psi. The pressure ranges mentioned in this specification are gauge pressure, that is, it is zero-referenced against ambient air pressure. The internal pressure of the first compartment 7*f* is suitably chosen so that the planar section of the ride surface 7 is relatively inflexible to provide a relatively smooth flow of water.

The internal pressure of the second compartment 7*g* is about 1 psi to about 30 psi. The internal pressure of the second compartment 7*g* is chosen to provide a relatively smooth flow of water and also a resilient impact surface for the rider. The internal pressure of the third compartment 7*h* is about 1 psi to about 30 psi. The internal pressure of the third compartment 7*h* is chosen to provide a resilient impact surface for the rider. The internal pressure of the fourth compartment is about 1 psi to about 30 psi.

The wave form has a valve (not shown) for controlling the air pressure in the wave form. The valve is connected to the base 3. The base 3 will have suitable conduits and outlets for controlling the air pressure in the wave form. Each compartment of the wave form has a valve. The pressure in each of the compartments may be varied to alter the way in which water flows over the wave form, which allows for different types of waves to be created. The pressure may also be adjusted to provide a softer or harder impact surface for the rider. Preferably, air is continually pumped into the compartments and is also allowed to continuously leak so that when a rider falls on the compartment, some of the air can exit the compartment, reducing the impact experienced by the rider.

Figure 14:
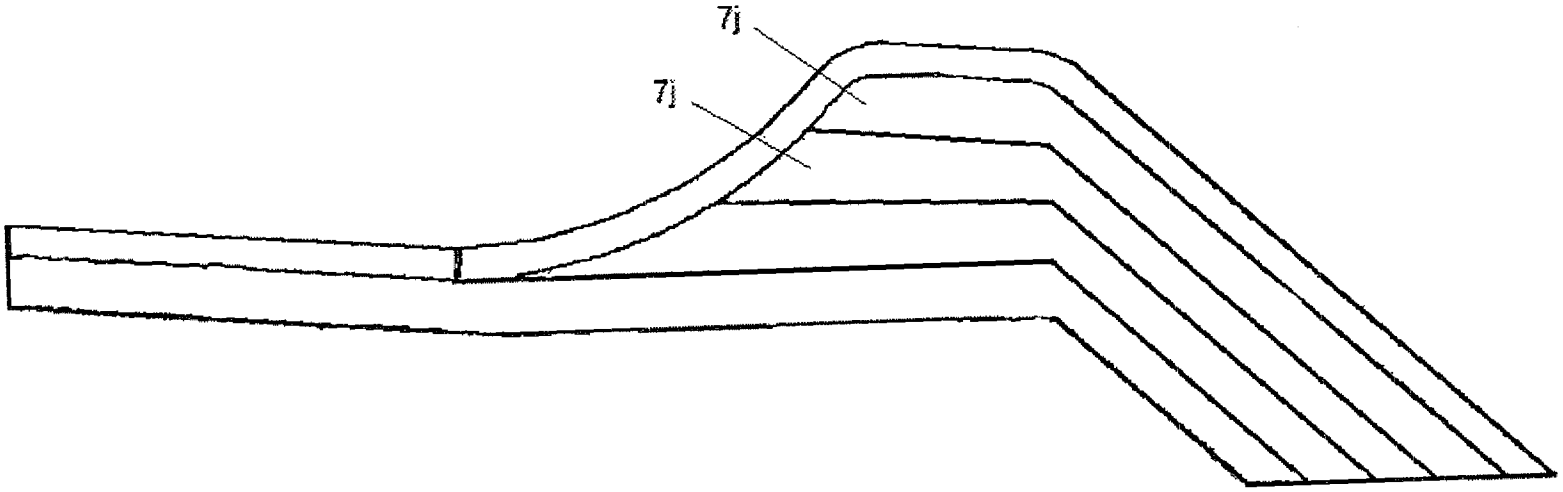
FIG. 14 is a cross-sectional view of a wave form.

In an alternative embodiment of the wave form, the compartments 7*j* may be vertically oriented, as shown in FIG. 14. In this alternative embodiment, the compressed air cells can be inflated and deflated separately. When the water flow is directed over the wave form, different sized waves can be formed by increasing and decreasing the air pressure. Different shaped waves can also be formed by increasing and decreasing the air pressure. Each cell section can be pressurised to different pressures which manipulates the shape and size of the wave. For example, one form can create a 300 mm to a 4 meter high wave. A form can have up to 10,000,000 cells, all of which are separately pressurised.

The wave form 2 is releasably attachable to the base 3 of the water ride attraction. The wave form may be releasably attachable via hook and look fasteners, zip fasteners, or dome fasteners, for example. To further secure the forms to the base, the water ride attraction has covers over the forms. The covers are releasably attachable to the base via hook and look fasteners, zip fasteners, or dome fasteners, for example. FIG. 13 shows the wave form having straps for attaching the form to the base. The straps are preferably about 1 meter long. In addition, the front of the wave form will have a rigid plastic component.

Figure 9:
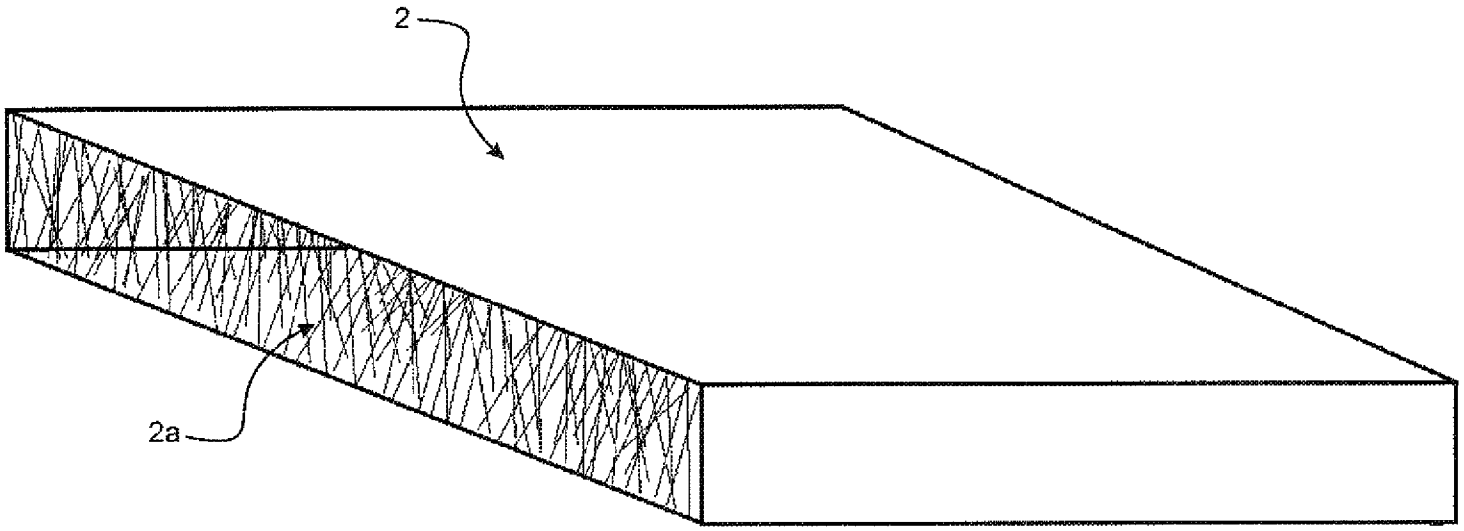
FIG. 9 is a schematic perspective view showing the construction of a compartment of the wave or wake form.

The wave form 2 is formed from a flexible sheet material. The flexible material may be chosen from cotton, polyester, rayon, or PVC for example. The flexible material will suitably comprise a waterproof material having a waterproof coating. The coating may be a laminate or coating of rubber, polyvinyl chloride, polyurethane, silicone elastomer, fluoropolymers, and/or wax. With reference to FIG. 9, the material of the wave form is held together by a plurality of strands 2*a*. The strands create a smooth surface for the wave form. In the preferred embodiment, there are two polypropylene surfaces held together at a distance of about 150 mm by individual strands, which makes sure the surface is as flat and as smooth as possible.

Figure 7:
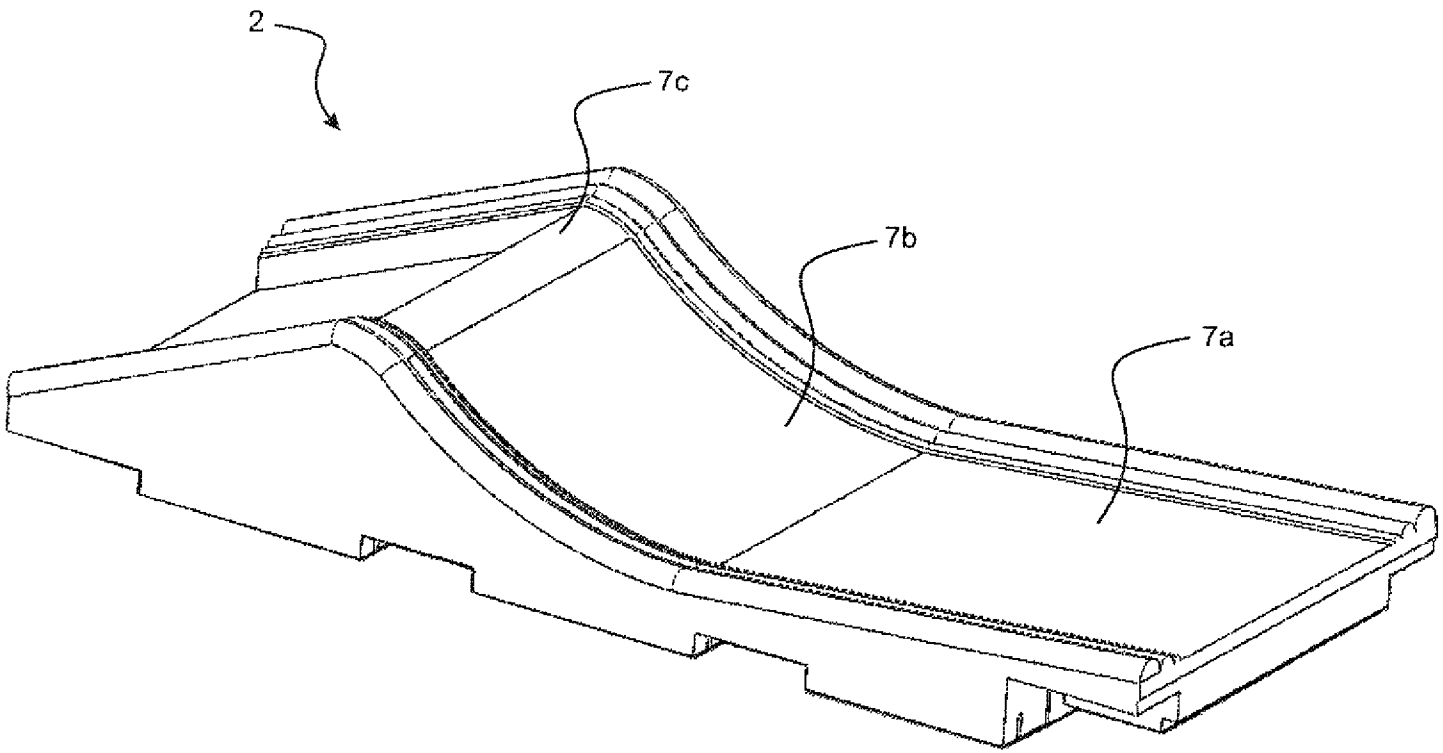
FIG. 7 is a perspective view of a wave form.

With reference to FIG. 7, a second preferred embodiment wake form is shown. The second preferred embodiment wake form is a wake/ramp form 102. The wake form is an inflatable cushion with a ride surface 107. The ride surface 107 has a substantially planar central section 107*a*, flanked by an upwardly inclined concave section on one side 107*b* and an upwardly inclined concave section 107*c* on the other side. The planar section and concave sections are integrally formed. The wake form also has a water delivery section 107*d* for delivering water to the central section and a water removal section for removing water from the central section.

In the preferred embodiment shown, the planar surface is inclined relative to a horizontal surface. The planar surface is inclined at an angle of about 0 degrees to about 89 degrees, preferably about 5 degrees relative to the horizontal surface.

In the preferred embodiment shown, the wake form further comprises side barriers 107*f* extending along the sides of the wake form. The side barriers 107*f* are integrally formed with the concave sections and follow the profile of the ride surface. The side barriers provide a resilient impact surface for the rider and substantially contain the water flow over the ride surface.

The cushion has an interior with compartments corresponding to the sections of the ride surface. The interior of the cushion has a central compartment 107*g* corresponding to the central section of the ride surface and side compartments 107*g* corresponding to the concave sections.

In the preferred embodiment shown, each of the compartments has a predetermined internal pressure. The internal pressure of the first compartment is a relatively high pressure compared to the pressure of the other compartments.

In the preferred embodiment shown, the internal pressure of the central compartment 107*g* is about 1 psi to about 30 psi. In the preferred embodiment shown, the internal pressure of each of the side compartments is about 1 psi to about 30 psi. The internal pressure of each of the central and side compartments is preferably chosen to provide a relatively smooth flow of water and also a resilient impact surface for the rider.

The wake form comprises a valve (not shown) for controlling the air pressure in the wake form. In the preferred embodiment, each compartment has a valve. The pressure in each of the compartments may be varied to alter the way in which water flows over the wake form, which allows for different types of waves to be created. The pressure may also be adjusted to provide a softer or harder impact surface for the rider.

In the preferred embodiment shown, the wake form has an additional wake forming projection in the form of an inflatable cushion. The additional wake forming projection may comprise a valve for controlling the air pressure in the additional wake forming projection. The pressure in the additional wake forming projection may be varied to alter the way in which water flows over the wake form, which allows for different types of waves to be created.

The additional wake forming projection preferably has a longitudinal direction aligned with the direction of water flow. The length of the additional wake forming projection in the longitudinal direction is about 1.5 meters. The width of the additional wake forming projection is about 300 mm, and the height of the additional wake forming projection is about 200 mm.

The wake form is formed from a flexible sheet material. The flexible material may be chosen from cotton, polyester, rayon, or PVC for example. The flexible material will suitably comprise a waterproof material having a waterproof coating. The coating may be a laminate or coating of rubber, polyvinyl chloride, polyurethane, silicone elastomer, fluoropolymers, and/or wax. The water delivery section may comprise a sheet of plastic glued to the surface of the air cushion. The sheet of plastic provides a solid and smooth surface over which water flows before it is delivered to the form.

Figure 10:
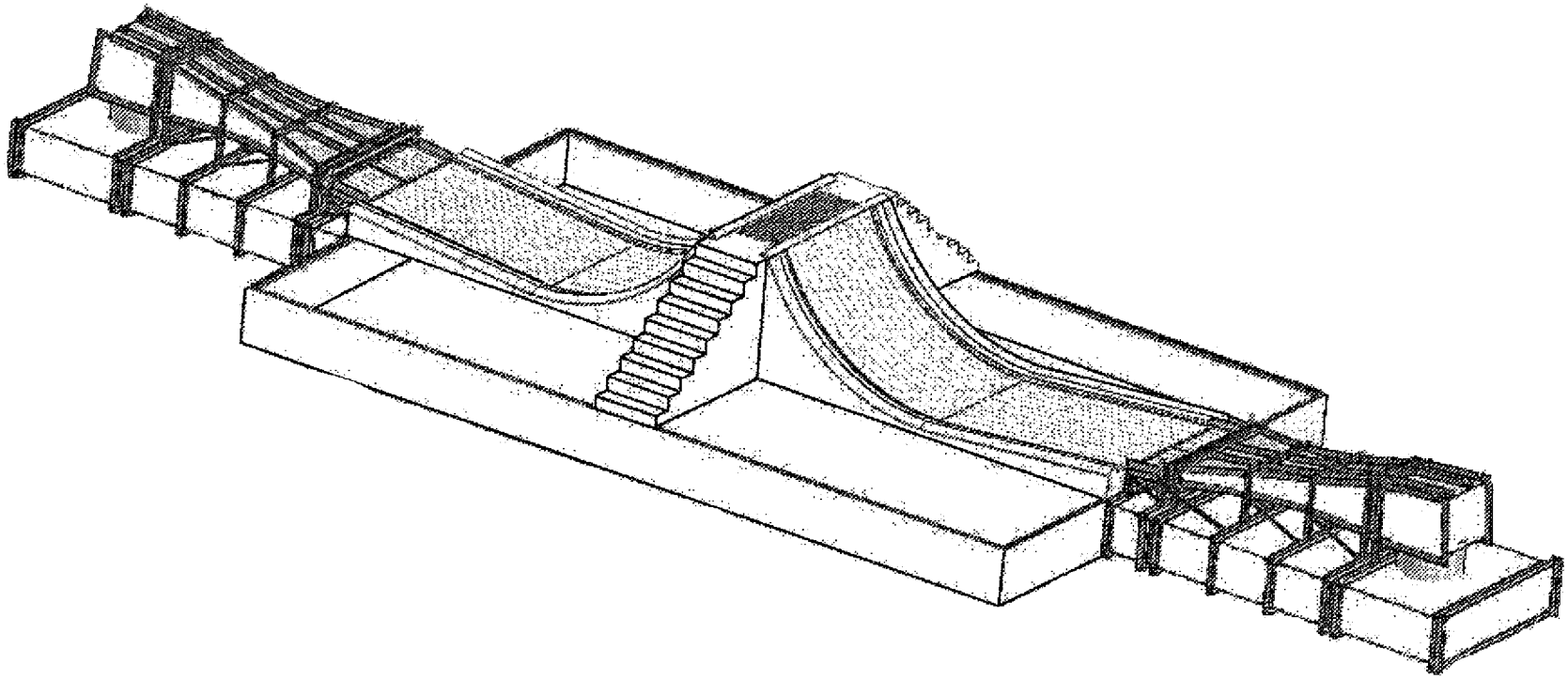
FIG. 10 is a perspective view showing two wave forms and water delivery arrangements associated together to form an alternative water ride attraction.

FIG. 10 shows two wave forms and water delivery arrangements associated together to form an alternative water ride attraction.

A method of entertaining a rider using a water ride attraction having the surfing wave form will now be described with reference to FIGS. 1 and 2.

Water is delivered to the wave form such that the water flows in a direction from the planar section, over the upwardly inclined concave section, and then over the horizontally inclined convex section. A rider is allowed to ride on the water above the ride surface in a direction generally transverse to the direction of water flow. In the preferred embodiment shown, the rider rides in a direction substantially perpendicular to the direction of water flow.

In a preferred method, the rider initially rides on the water above the planar section of the wave form and is carried to the concave section by the flow of water. Once at the concave section, the rider can ride on the water above the concave section of the ride surface. After a predetermined amount of time, preferably one minute, the flow of water is ceased, causing the rider to exit the riding area of the water ride attraction. The rider may land on the convex section, on one of the side barriers, and/or in the pool 9.

The internal pressure of one or more of the compartments of the wake form may be adjusted. The internal pressure may be adjusted before and/or during a rider riding on the water.

The wave form can be removed and replaced with a different form. Alternatively, one or more compartments may be inflated or deflated to provide a desired ride surface.

The method includes collecting water from the wake form in a pool 9 and delivering the water collected in the pool 9 to the water reservoir. The water is preferably delivered to the water reservoir by pumping the water. In a preferred method, the water is continuously recycled from the pool 9 to the reservoir, over the ride surface and back to the pool 9.

In the preferred method, the water delivery arrangement is adapted to deliver water to the inflatable wave form at a speed of up to about 50 km/hr, preferably about 30 km/hr.

Figure 8:
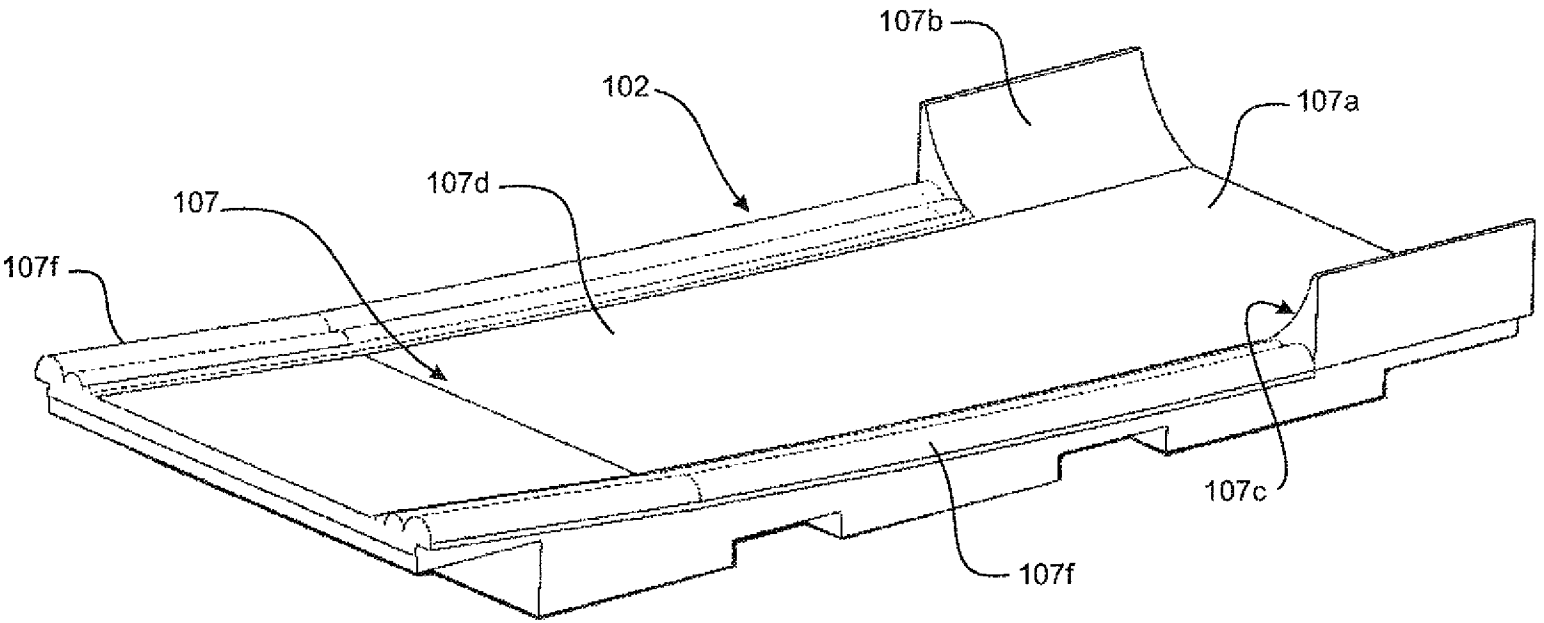
FIG. 8 is a perspective view of a wake form.

A method of entertaining a rider using a water ride attraction having the surfing wave from will now be described with reference to FIG. 8. FIG. 8 shows the wake form separate from the other components of the water ride attraction. However, it will be appreciated that unless described below, the method is similar to the method described above in relation to the surfing wake form.

In the preferred method for using the wake/ramp form shown, the rider initially grasps the handle of the retractable line, rides along the planar section of the wave form and then is carried to the concave section by the flow of water. The line will tighten when the rider is in the correct position. The rider rides in a direction substantially perpendicular to the direction of water flow.

The rider may ride at least partly over one of the side concave surfaces, through the central section and at least partly over the other of the side concave surfaces. The rider may repeatedly ride from one side to the other and back again. After a predetermined amount of time, preferably one minute, the flow of water is ceased, causing the rider to exit the riding area of the water ride attraction. The rider may land on the wake form, on one of the side barriers, and/or in the pool 9.

The wake/wave form can be removed and replaced with a different wave form.

Preferred embodiments of the invention have been described by way of example only and modifications may be made thereto without departing from the scope of the invention.

For example, in the preferred embodiments described, the cushion is filled with air. In an alternative embodiment, the cushion may be filled with a suitable gas or liquid.

The wave and wake forms have been described as being attached to the base of the water ride attraction. Alternatively, the forms may be free to float on a water surface. It will be appreciated that the water ride attraction is mobile and the forms can be put into a pool, lake or sea.

Another alternative use of the wave or wake form would be to place the form in a swimming pool and pump water over the form to create waves for a rider.

The invention claimed is:

1. A wave form for a water ride attraction comprising:

an inflatable cushion having a ride surface and an interior;

the ride surface being adapted to support a rider, the ride surface having an elongate direction, a substantially planar section, follow by an upwardly inclined concave section, and then a horizontally inclined convex section, the horizontally inclined convex section being positioned above the substantially planar section and the upwardly inclined concave section;

the ride surface being arranged to allow a flow of water to flow in the elongate direction and allow a rider to ride above the ride surface in a direction generally transverse to the direction of water flow; and the interior having a first compartment corresponding to the planar section of the ride surface, a second compartment corresponding to the concave section of the ride surface, and a third compartment corresponding to the convex section of the ride surface, the compartments forming a support structure of the wave form and each compartment comprising a plurality of longitudinal adjacent cells extending in the elongate direction, each cell being adapted such that the pressure of the cell can be increased or decreased to manipulate the shape and size of the wave formed by the wave form.

2. A wave form according to claim 1, wherein the planar section is adapted to direct water to flow to the concave section and the concave section is adapted to direct water to flow to the convex section.

3. A wave form according to claim 1, wherein the planar surface is inclined relative to a horizontal surface.

4. A wave form according to claim 1, wherein the wave form further comprises a water removal section for removing water from the convex section.

5. A wave form according to claim 1, wherein the wave form further comprises side barriers extending along the sides of the wave form.

6. A wave form according to claim 1, wherein the first compartment has an internal pressure that is relatively high compared to the pressure of the other compartments.

7. A wave form according to claim 1, wherein the internal pressure of the first compartment causes the planar section of the ride surface to be relatively inflexible.

8. A wave form according to claim 1, wherein the internal pressure of the second compartment provides a resilient impact surface for a rider.

9. A wave form according to claim 1, wherein the internal pressure of the third compartment provides a resilient impact surface for a rider.

10. A wave form according to claim 1, wherein the wave form is releasably attachable to a water ride attraction.

11. A wave form according to claim 1, wherein the wave form is formed from a flexible sheet material.

12. A wave form according to claim 1, wherein the cushion is filled with air.

13. A wake form for a water ride attraction comprising:

an inflatable cushion having a ride surface and an interior, the ride surface having an elongate direction, a substantially planar central section, flanked by an upwardly inclined concave section on one side and an upwardly inclined concave section on the other side, the ride surface being arranged to allow a flow of water to flow in the elongate direction and allow a rider to ride above the ride surface in a direction generally transverse to the direction of water flow;

the interior having a central compartment corresponding to the central section of the ride surface and side compartments corresponding to the concave sections of the ride surface, the compartments forming a support structure of the wake form and each compartment comprising a plurality of longitudinal adjacent cells extending in the elongate direction, each cell being adapted such that the pressure of the cell can be increased or decreased to manipulate the shape and size of the wave formed by the wave form.

14. A wake form according to claim 13, wherein the wake form further comprises a water delivery section for delivering water to the central section.

15. A wake form according to claim 13, wherein the water delivery section extends downwardly towards the central section.

16. A wake form according to claim 13, wherein the planar surface is downwardly inclined relative to a horizontal surface.

17. A wake form according to claim 13, wherein the wake form further comprises side barriers extending along the sides of the wake form.

18. A wake form according to claim 13, wherein the planar section and concave sections are integrally formed.

19. A wake form according to claim 13, wherein the cushion is filled with air.

20. A wake form according to claim 13, wherein the internal pressure of the central compartment is a relatively high pressure compared to the pressure of the other compartments.

21. A wake form according to claim 13, wherein the wake form is releasably attachable to a water ride attraction.

22. A wake form according to claim 13, wherein the wake form is formed from a flexible sheet material.

23. A wake form according to claim 13, wherein the wake form has an additional wake forming projection.

24. A method of entertaining a rider using a water ride attraction comprising:

providing a water ride attraction having an inflatable wake form of claim 13;

delivering water to the wake form such that the water flows in a direction over the central section;

allowing a rider to ride on the water in a direction substantially transverse to the direction of water flow.

25. A method according to claim 24, wherein the rider rides in a direction substantially perpendicular to the direction of water flow.

26. A method according to claim 24, wherein the rider rides at least partly over one of the side concave surfaces, through the central section and at least partly over the other of the side concave surfaces.

27. A method according to claim 24, wherein the rider initially rides along the planar section of the wake form and is carried to the concave section by the flow of water.

28. A method according to claim 24, further comprising ceasing the flow of water, causing the rider to exit the riding area of the water ride attraction.

29. A method according to claim 24, wherein the period of time that the rider uses the water ride attraction is controllable.

30. A method according to claim 24, further comprising adjusting the internal pressure of one or more of the compartments of the wake form.

31. A method according to claim 24, further comprising removing the inflatable wake form and replacing the inflatable wake form with a different inflatable wake form.

32. A method according to claim 24, further comprising collecting water from the wake form in a pool.

33. A method according to claim 24, further comprising delivering the water collected in the pool to a water reservoir for storing water.

34. A method according to claim 24, further comprising delivering water to the inflatable wake form at a speed of up to about 50 km/hr.

35. A water ride attraction comprising:

an inflatable wave form or wake form having a ride surface and an interior, the ride surface having an elongate direction, the interior having two or more compartments, the compartments forming a support structure of the wave form and each compartment comprising a plurality of longitudinal adjacent cells extending in the elongate direction, each cell being adapted such that the pressure of the cell can be increased or decreased to manipulate the shape and size of the wave formed by the wave form; and a water delivery arrangement for delivering a flow of water to the inflatable wave form or wake form in a flow direction, the flow direction being parallel to the elongate direction;

the ride surface being so arranged as to allow a rider to ride on the flow of water above the ride surface in a direction generally transverse to the direction of water flow.

36. A water ride attraction according to claim 35, wherein the inflatable wave form or wake form is selectively interchangeable with another inflatable wave form or wake form.

37. A water ride attraction according to claim 35, wherein the water ride attraction further comprises a base and the inflatable wave form or wake form is releasably attachable to the base.

38. A water ride attraction according to claim 35, wherein the water delivery arrangement further comprises a water reservoir for storing water.

39. A water ride attraction according to claim 35, wherein the water delivery arrangement further comprises a pump for pumping water to the water reservoir.

40. A water ride attraction according to claim 35, wherein the water delivery arrangement is be adapted to deliver water from a lake, river, stream, or the sea.

41. A water ride attraction according to claim 35, further comprising a pool for collecting water from the wave form or wake form.

42. A water ride attraction according to claim 35, wherein the water delivery arrangement is adapted to deliver water to the inflatable wave form or wake form at a speed of up to about 50 km/hr.

43. A water ride attraction according to claim 35, wherein the water delivery arrangement is adapted to deliver water to the inflatable wave form or wake form at a depth of about 75 mm to about 1 meter.

44. A water ride attraction according to claim 35, further comprising a line having a first end attached to a support and a second end for the rider to hold.

45. A water ride attraction according to claim 35, wherein the inflatable wake form comprises:

an inflatable cushion having a ride surface and an interior, the ride surface having a substantially planar central section, flanked by an upwardly inclined concave section on one side and an upwardly inclined concave section on the other side;

the interior having a central compartment corresponding to the central section of the ride surface and side compartments corresponding to the concave sections of the ride surface, the compartments forming a support structure of the wake form and each compartment comprising a plurality of longitudinal adjacent cells, each cell being adapted such that the pressure of the cell can be increased or decreased to manipulate the shape and size of the wave formed by the wave form.

46. A method of entertaining a rider using a water ride attraction comprising:

providing a water ride attraction having an inflatable wave form of claim 1;

delivering water to the wave form such that the water flows in a direction from the planar section, over the upwardly inclined concave section, and then over the horizontally inclined convex section; and allowing a rider to ride on the water above the ride surface in a direction generally transverse to the direction of water flow.

47. A method according to claim 46, wherein the rider rides in a direction substantially perpendicular to the direction of water flow.

48. A method according to claim 46, wherein the rider initially rides on the water above the planar section of the wave form and is carried to the concave section by the flow of water.

49. A method according to claim 46, wherein the method further comprises ceasing the flow of water, causing the rider to exit the riding area of the water ride attraction.

50. A method according to claim 46, wherein the period of time that the rider uses the water ride attraction is controllable.

51. A method according to claim 46, further comprising adjusting the internal pressure of the wave form.

52. A method according to claim 46, further comprising removing the inflatable wave form and replacing the inflatable wave form with a different inflatable wave form.

53. A method according to claim 46, further comprising collecting water from the wave form in a pool.

54. A method according to claim 53, further comprising delivering the water collected in the pool to the water reservoir.

55. A method according to claim 46, further comprising delivering water to the inflatable wave form at a speed of up to about 50 km/hr.

56. A method according to claim 46, further comprising delivering water to the inflatable wave form at a depth of about 75 mm to about one meter.

* * * * *